US007001262B2

(12) United States Patent
Tong

(10) Patent No.: US 7,001,262 B2
(45) Date of Patent: Feb. 21, 2006

(54) SYSTEM FOR DYNAMIC AIRFLOW CONTROL IN A PAINT BOOTH USING MULTIPLE AIR SUPPLY PLENUMS

(75) Inventor: Ernest Henry Tong, Canton, MI (US)

(73) Assignee: Ford Motor Company, Dearborn, MI (US)

( * ) Notice: Subject to any disclaimer, the term of this patent is extended or adjusted under 35 U.S.C. 154(b) by 2 days.

(21) Appl. No.: 10/604,595

(22) Filed: Aug. 1, 2003

(65) Prior Publication Data

US 2005/0048897 A1 Mar. 3, 2005

(51) Int. Cl.
*B05B 15/12* (2006.01)

(52) U.S. Cl. ..... 454/52; 118/326

(58) Field of Classification Search ..... 454/50, 454/51, 52; 118/326, DIG. 7
See application file for complete search history.

(56) References Cited

U.S. PATENT DOCUMENTS 4,131,059 A * 12/1978 Gustavsson ..... 454/189
4,616,594 A * 10/1986 Itho ..... 118/326
4,653,387 A 3/1987 Osawa et al.
5,356,335 A 10/1994 Matsui et al.
5,480,349 A 1/1996 Kolta
5,512,017 A 4/1996 Gore et al.
5,762,548 A * 6/1998 Milojevic et al. ..... 454/52
5,820,456 A 10/1998 Nelson
5,855,509 A 1/1999 White et al.
6,139,421 A 10/2000 Tong et al.
6,146,264 A 11/2000 Tong et al.
6,226,568 B1 5/2001 Tong et al.
6,361,605 B1 3/2002 Shutic et al.

FOREIGN PATENT DOCUMENTS

GB 2124752 A * 2/1984

* cited by examiner

*Primary Examiner*—Harold Joyce
(74) *Attorney, Agent, or Firm*—Raymond L. Coppiellie; Dykema Gossett PLLC

(57) ABSTRACT

A system and method for handling airflow in a paint booth where a primary plenum encloses a secondary plenum having a damper to control the amount of air entering the secondary plenum from the primary plenum. The secondary plenum is installed above a paint spray applicator and an anemometer. A damper at the secondary plenum inlet controls the amount of airflow from the primary plenum in real time based at least in part on the air velocity detected by the anemometer. The present invention can be employed with a system having variable density filter media extending across the primary plenum outlet to regulate the velocities of air moving through various locations of the paint booth.

12 Claims, 2 Drawing Sheets

22
21
20
23
2
32
3
31
3
70
30
70
61
24
33
80
80
60
50
40
51
10
81
2

1
22
21
30
23
20
34
32
73
31
73
71
71
35
33
40
60
82
82
83
83
84
84
81
1

SYSTEM FOR DYNAMIC AIRFLOW CONTROL IN A PAINT BOOTH USING MULTIPLE AIR SUPPLY PLENUMS

BACKGROUND OF INVENTION

1. Field of the Invention

The present invention relates to a system and method for handling airflow in a paint booth.

2. Disclosure Information

Modern painting techniques routinely use a series of paint booth cells to prepare and finish the surface of items such as automotive vehicle bodies. Typically, a vehicle body is transported through a series of paint spray booths where the workpiece surface is prepared and primed and paint is applied, dried, and finished. Much of the priming, painting and finishing is commonly performed by automated equipment. During this process, some of the applied materials may not adhere to the vehicle, but appear as over-spray in the booth atmosphere. This over-spray must be removed from the paint spray booth for example, to keep it from falling back on the painted vehicle or from being inhaled by equipment operators. The paint over-spray is typically removed by providing a continuous airflow from a supply plenum above the paint spray booth, through the paint spray booth and out to scrubber equipment which removes paint particles before exhausting the air to the atmosphere.

It is recognized that varying airflow velocity at different locations within a paint spray booth yields beneficial results. Increasing airflow velocity next to paint booth walls and equipment minimizes paint adhesion to these surfaces. Reducing air velocity near substantially vertical portions of a vehicle body promotes paint adhesion to such surfaces. Where horizontal surfaces are to be painted, however, it is recognized that increasing the velocity of the airflow and paint spray impacting the horizontal surface produces better results.

The current invention improves the control the airflow within a paint booth by actively controlling the airflow upon generally horizontal surfaces to be painted. A secondary air supply plenum is enclosed within a primary air supply plenum, from which it receives its air supply. The secondary plenum is located directly above automatic paint spray equipment used to paint generally horizontal surfaces of the workpiece. An air velocity detector is installed underneath the secondary plenum outlet and sends a signal to a damper controlling air intake at the secondary plenum inlet. The air velocity over generally horizontal workpiece surfaces is dynamically adjusted in real time to optimal values by using said damper to control the amount of air admitted into the secondary plenum, based at least in part on the air velocity detected near the automotive paint spray equipment. Continuous measurement and adjustment of airflow velocity promotes consistency and painting efficiency.

U.S. Pat. No. 5,480,349 illustrates a system in which a secondary plenum receives air under pressure from the first plenum, and wherein the atmospheric pressure of air in the second plenum is measured and controlled by increasing the air supply to the first plenum. The present invention differs in several respects from the '349 patent. In particular, the present invention regulates airflow based on air velocity, which is more accurate and reliable than a system based on measuring air pressure. Further, the '349 patent dynamically adjusts the amount of air supplied to the primary plenum only; the amount of air supplied to the secondary plenum is controlled by a set of sliding plates positioned during a setup process. In contrast, the current invention does not vary the amount of air supplied to the primary plenum, but actively controls the amount of air supplied to the secondary plenum directly, based at least in part on air velocity measured beneath the secondary plenum. The present invention permits more accurate adjustments of airflow at targeted locations within the paint booth and is less susceptible to changes in atmospheric pressure and other variable conditions commonly encountered in multi-cell paint booth systems. The present invention promotes consistent downdraft at key areas in a paint booth cell even when used in conjunction with airflow handling systems that dynamically adjust air supplied to primary plenums in order to balance lateral airflows between cells in multi-cell systems.

SUMMARY OF INVENTION

According to the present invention, a system and method for handling airflow in a paint booth. To increase the velocity of paint impacting generally horizontal surfaces, a secondary plenum is installed within a primary air supply plenum and above an automated paint spray applicator. A damper controls the amount of airflow admitted into the secondary plenum from the primary plenum, which damper is dynamically adjusted at least in part according to the air velocity detected beneath the secondary plenum outlet. When greater velocity is desired, the damper at the secondary plenum input can be opened further to admit more airflow from the primary plenum, resulting in an increase in the velocity of paint spray applied on the horizontal surface of the workpiece. The present invention can be used in combination with variable density filter media extending across the primary plenum outlet to further regulate the velocity of air moving through various locations of the paint booth.

Other advantages, as well as objects and features of the present invention, will become apparent to the reader of this specification.

DETAILED DESCRIPTION

Figure 1:
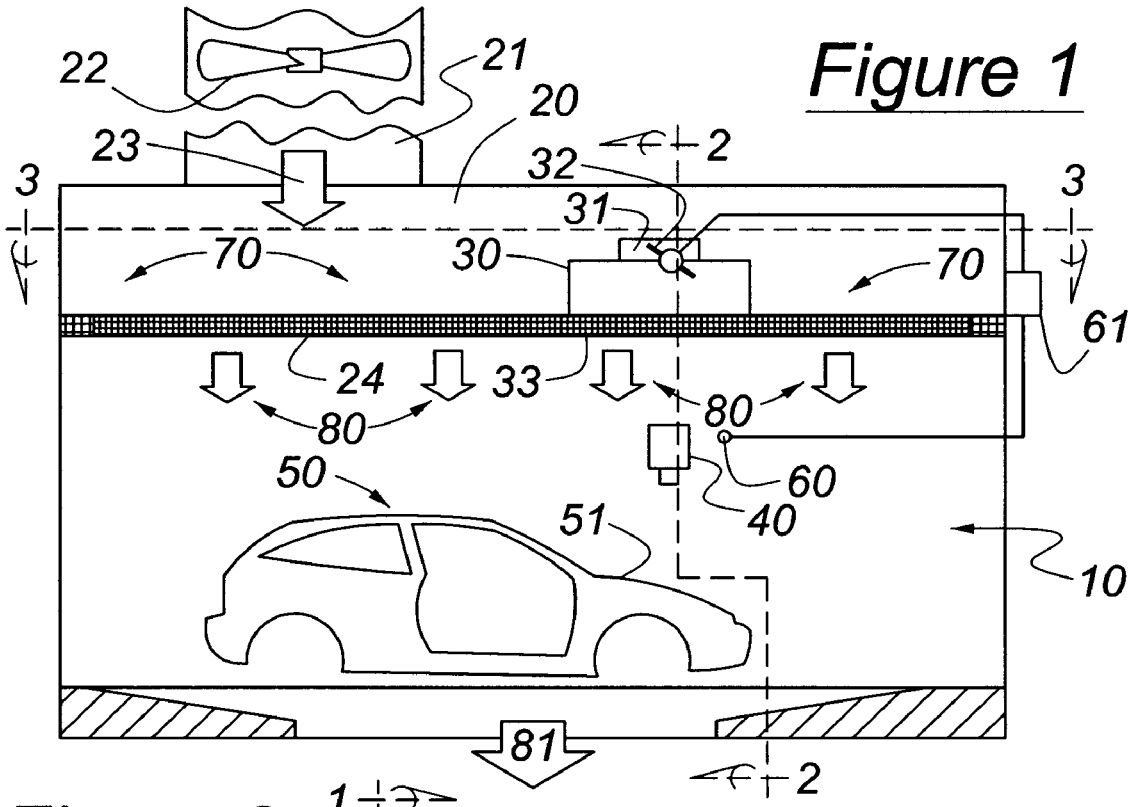
FIG. 1 shows a profile of an automotive paint booth cell with a primary plenum enclosing a secondary plenum.
Figure 2:
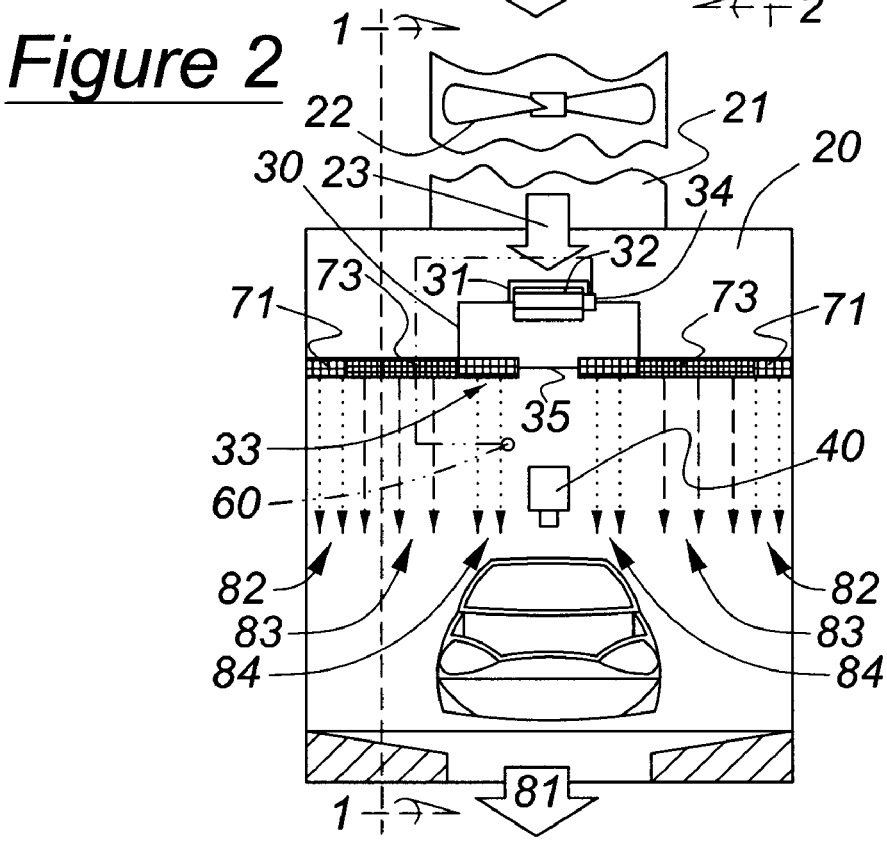
FIG. 2 is a front perspective of the paint booth showing the primary and secondary plenums and depicting variable airflow velocity within the paint cell booth.

As shown in FIGS. 1 and 2, paint booth cell 10 is shown with a workpiece 50, in this case an automotive vehicle body 50, within paint booth 10. In the configuration shown, air moves in a downward direction from overhead air supply plenums. FIGS. 1 and 2 show a primary plenum 20 and a secondary plenum 30. Primary plenum 20 has a primary plenum inlet 21 supplied with air by a fan 22. Air moves through the primary plenum and into the paint booth through a primary plenum outlet 24. Within primary plenum 20 is a secondary plenum 30 having a secondary plenum inlet 31 and secondary plenum outlet 33. Secondary plenum 30 is located generally above a paint spray applicator 40. Paint spray applicator 40 is positioned above a generally horizontal surface 51 of the workpiece 50. As noted above, secondary plenum 30 receives air through secondary plenum inlet 31 from higher pressure air within primary plenum 20. Adjustable damper 32 controls the amount of air entering secondary plenum inlet 31. Air velocity measuring device 60, such as an anemometer, is installed underneath secondary plenum outlet 33. Air velocity measuring device 60 transmits a signal corresponding to the air velocity beneath the secondary plenum outlet 33 to controller 61. Controller 61 then transmits a signal, based at least in part on the measured air velocity signal to damper controller mechanism 34 (FIG. 3), preferably a common stepper motor adapted to incrementally rotate damper 32 over at least 90° of rotation.

To create a more even and controlled air flow, as well as to filter any impurities in the air, filter media 70 preferably extends across primary plenum outlet 24 and secondary outlet 33. To assure proper air movement and damper functionality between primary plenum 20 and secondary plenum 30, the average unit density of the filter media across the primary plenum outlet 24 must be greater than the average unit density of the filter media across the secondary plenum outlet 33. FIG. 1 shows primary plenum 20 being supplied with air at a superatmospheric pressure by fan 22 through primary plenum inlet 23. Other means of achieving proper directional airflow include use of powerful exhaust fans drawing exhaust air 81 or compressors. Primary plenum 20 encloses secondary plenum 30 which receives air supply through secondary plenum inlet 31. Air flow 80 enters the paint cell booth 10 after exiting from primary plenum outlet 24 and secondary plenum outlet 33. Exhaust airflow 81, containing any airborne paint particles, exits the lower portion of the paint cell booth 10 for treatment by environmental equipment.

In the configuration shown in the various figures, secondary plenum 30 is located immediately above paint spray applicator 40. Those skilled in the art will appreciate in view of this disclosure that other configurations could be derived in which secondary plenum outlet 33 is moveable, either independently or dependent on the position of the moveable workpiece 50, or possibly based on the position of moveable paint spray applicator 40. Similarly, primary plenum 20 might enclose more than one secondary plenums 30, each having a controllable damper mechanism 32, permitting dynamic adjustment of airflow velocities at multiple locations within paint booth cell 10. An air velocity detector 60 is placed below secondary plenum outlet 33 and near paint spray applicator 40. The air velocity detector, or anemometer, could be either mechanical, or of the "hot wire" type, or model-based and running in software associated with operation of the airflow system. The air velocity detector transmits a signal corresponding to air velocity to a controller 61. Said controller could be adapted to receive a variety of input variables, such as atmospheric pressure or air velocities at various locations in the paint booth system, speed of fan 22, position of spray applicator 40, or manual override inputs. Based at least in part on the value of said air velocity signal, controller 61 transmits a signal to an adjustable damper control apparatus 34. Adjustable damper control apparatus 34 then adjusts the position of damper 32 at the secondary plenum inlet to control the amount of airflow admitted into and through secondary plenum 30. As damper 32 is closed, airflow into secondary plenum 30 is restricted and decreases, thereby decreasing velocity of airflow 80 from secondary plenum outlet 33. Conversely, as damper 32 is opened, airflow into secondary plenum 30 increases, resulting in higher velocity of air exiting the secondary plenum outlet 33 and higher velocity of paint spray impacting horizontal surfaces 51 of the workpiece 50.

Figure 4:
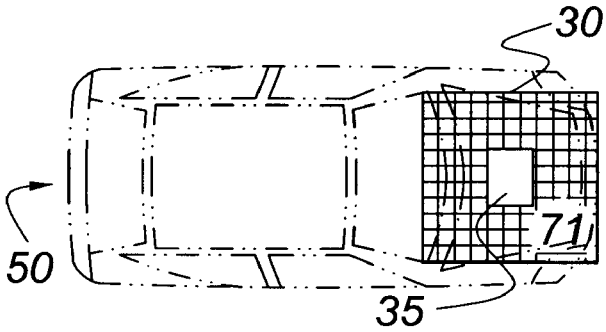
FIG. 4 is a plan view of a secondary plenum outlet having an airflow restrictor installed above a paint spray applicator.
Figure 5:
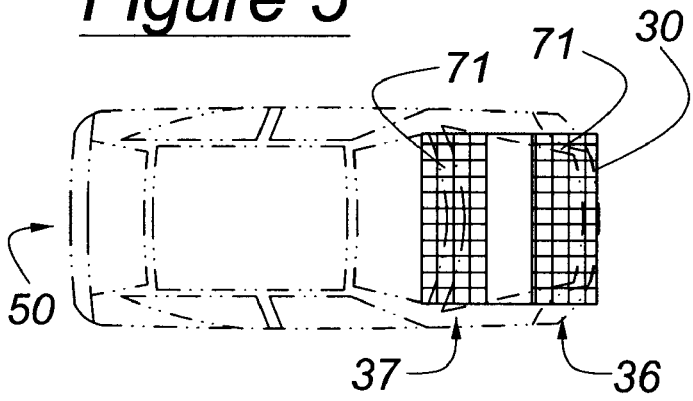
FIG. 5 is a plan view of a secondary plenum outlet divided into a forward section and an aft section.

As shown in FIGS. 2 and 4, an airflow restrictor or blanking plate 35 is preferably installed directly over paint spray applicator 40 to reduce the amount of air directly impinging on the paint spray applicator mechanism and to reduce unwanted air turbulence around paint spray applicator 40. Alternatively, as shown in FIG. 5, the secondary plenum outlet maybe divided into a forward section 36 and an aft section 37 with such a configuration similarly minimizing the amount of higher-velocity air directly impinging on paint spray applicator mechanism 40. Paint spray applicator 40 is preferably the rapid rotation bell-type.

Figure 3:
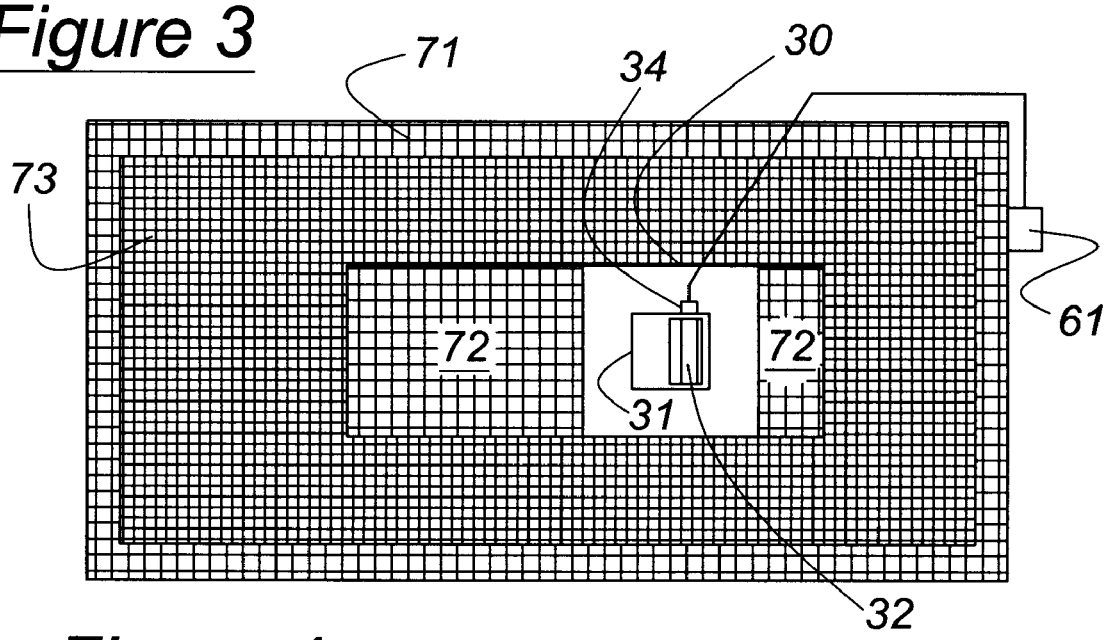
FIG. 3 is a plan view of a possible configuration of variable density filter media extending across a primary plenum outlet and a secondary plenum.

The present invention may be usefully combined with variable density filter media 70 extending across primary plenum outlet 24. As noted, higher velocity airflow above generally horizontal surfaces being painted by spray applicators is recognized as producing better results than lower velocity airflow. Conversely, when paint is sprayed on generally vertical portion of a workpiece, lower air velocities are preferred. Higher velocity is also desired near the walls of paint booth cells and in areas where a human operator is located. As shown in FIG. 3, variable density filter media may be placed at primary plenum outlet 24 and secondary plenum outlet 33 to regulate the amount of airflow and relative airflow velocities at these locations. Low density filter medium 71 may be installed around the perimeter of primary plenum outlet 24 so as to promote higher velocity airflows along the walls of paint booth cell 10 thereby discouraging paint adhesion to paint cell walls and equipment. Such higher velocity airflows are shown in FIG. 2 as dotted lines 82. Higher density filter medium 73 may be installed across other locations of primary plenum outlet 24 to promote lower velocity airflows at locations where high velocity airflow is not desired. FIG. 2 shows the resulting lower velocity airflows as dashed lines 83. Medium density filter media 72 may be installed in areas above the workpiece to be painted where medium velocity airflow is desired. Relatively low density filter medium 71 would preferably be installed across the secondary plenum outlet 33 as shown in FIGS. 4 and 5. The present invention permits airflow from secondary plenum outlet 33 to enter the paint booth cell 10 at a higher velocity, shown in FIG. 2 as dotted lines 84. FIGS. 2 and 3 illustrate a very basic configuration for arranging variable density filter media. Those skilled in the art will appreciate in view of this disclosure that there are an almost unlimited number of patterns and degrees of density for the variable density filter media that might be installed across the primary plenum outlet 24 and the secondary plenum outlet 33 with corresponding variations of airflow velocities and patterns resulting in the paint cell booth below.

Although the present invention has been described in connection with particular embodiments thereof, it is to be understood that various modifications, alterations, and adaptations may be made by those skilled in the art without departing from the spirit and scope of the invention. It is intended that the invention be limited only by the appended claims.

The invention claimed is:

1. A system for handling airflow in a paint booth, comprising:

a paint booth adapted to receive airflow from two or more plenum outlets located above the paint booth;

a primary plenum supplied with higher pressure air by an air source and having a primary plenum outlet;

a secondary plenum, enclosed within the primary plenum and supplied with air by the primary plenum, with said secondary plenum having a secondary plenum outlet adjacent to a portion of said primary plenum outlet and generally above a paint spray applicator and above a workpiece within said paint booth;

an airflow detector, within the paint booth near said paint spray applicator, adapted to transmit a signal corresponding to the velocity of the airflow between the secondary plenum outlet and said workpiece; and an adjustable damper adapted to dynamically control airflow from the primary plenum to the secondary plenum based at least in part on the real-time value of said air velocity signal.

2. An airflow handling system according to claim 1, further comprising variable density filter media across both of said plenum outlets, with said variable density filter media creating differential air velocity flows at various locations in said paint booth.

3. An airflow handling system according to claim 2, wherein the filter media at the secondary plenum outlet is less dense than the average filter media density at the primary plenum outlet.

4. An airflow handling system according to claim 3, wherein the filter media at the primary plenum outlet is comprised of a combination of higher density filter media and lower density filter media.

5. An airflow handling system according to claim 4, wherein said filter media has a relatively higher density at a plurality of locations at the primary plenum outlet, thereby creating low velocity airflow beneath said locations within the paint booth.

6. An airflow handling system according to claim 5, wherein said filter media has a relatively lower density at a plurality of locations at the primary plenum outlet thereby creating high velocity airflow beneath said locations within the paint booth.

7. An airflow handling system according to claim 1, wherein said paint spray applicator is adapted to paint generally horizontal surfaces.

8. An airflow handling system according to claim 1, wherein the secondary plenum is adapted to minimize the airflow impinging directly on said paint spray applicator.

9. An airflow handling system according to claim 8 wherein an airflow restrictor is located at,the secondary plenum outlet directly above said paint spray applicator.

10. An airflow handling system according to claim 8, wherein the secondary plenum outlet is divided into a forward secondary plenum outlet section located forward of said paint spray applicator and an aft secondary plenum outlet section located aft of said paint spray applicator.

11. A system for handling airflow in a paint booth comprising:

a paint booth adapted to receive airflow from two or more plenum outlets located above the paint booth;

a primary plenum supplied with higher pressure air from an air source and having a primary plenum outlet;

a secondary plenum within the primary plenum, supplied with air by the primary plenum and having a secondary plenum outlet adjacent to a portion of said primary plenum outlet and generally above a paint spray applicator within said paint booth, wherein relatively low density filter media extends between the secondary plenum outlet and the balance of the paint booth, and wherein the secondary plenum outlet has one or more airflow restrictors directly above the paint spray applicator;

a variable density filter media extending across the primary plenum outlet, with relatively higher density media being installed at a plurality of locations at the primary plenum outlet, thereby creating lower velocity airflow beneath said locations within the paint booth, and with relatively lower density media being installed at a plurality of locations at the primary plenum outlet, thereby creating high velocity airflow beneath said locations;

an airflow velocity detector within the paint booth and near said paint spray applicator, adapted to transmit a signal corresponding to air velocity below the secondary plenum outlet; and an adjustable damper for controlling airflow from the primary plenum to the secondary plenum based at least in part on the value of said air velocity signal.

12. A method of controlling airflow velocity in a paint booth comprising:

supplying air under pressure to a primary plenum having a primary plenum outlet located above a paint booth;

supplying air from the primary plenum to a secondary plenum that is enclosed within the primary plenum, with said secondary plenum having a secondary plenum outlet located generally above a paint spray applicator and above a workpiece within said paint booth;

using an airflow velocity detector, installed in the airflow between the secondary plenum outlet and said workpiece, to generate a signal corresponding to air velocity beneath the secondary plenum outlet; and dynamically controlling the air supplied to the secondary plenum in real time by adjusting a damper at a secondary plenum inlet based at least in part on the value of said air velocity signal.

* * * * *